United States Patent [19]

Roof et al.

[11] Patent Number: 4,594,147

[45] Date of Patent: Jun. 10, 1986

[54] CHOLINE AS A FUEL SWEETENER AND SULFUR ANTAGONIST

[75] Inventors: Glenn L. Roof, Sugar Land; Beth W. Porlier, Missouri City; Wesley E. Cravey, Friendswood, all of Tex.

[73] Assignee: Nalco Chemical Company, Oak Brook, Ill.

[21] Appl. No.: 809,652

[22] Filed: Dec. 16, 1985

[51] Int. Cl.[4] ..... C10G 29/00; C10G 29/20

[52] U.S. Cl. ..... 208/207; 208/236; 208/237; 208/263

[58] Field of Search ..... 208/207, 236, 237, 263

[56] References Cited

U.S. PATENT DOCUMENTS 2,671,048 3/1954 Rosenward ..... 208/207

4,430,196 2/1984 Niu ..... 208/236

OTHER PUBLICATIONS

Merck Index, 10th Edition, Merck & Company Inc., 1983.

Journal of Organic Chemistry, vol. 41, No. 23, 3773 (1976).

*Primary Examiner*—Andrew H. Metz
*Assistant Examiner*—Chung K. Pak
*Attorney, Agent, or Firm*—John G. Premo; Donald G. Epple; Anthony L. Cupoli

[57] ABSTRACT

Choline has been shown to be an improved sweetener for petroleum fuels, particularly gasoline. It is also capable of reducing the sulfur content of these fuels.

1 Claim, No Drawings

CHOLINE AS A FUEL SWEETENER AND SULFUR ANTAGONIST

INTRODUCTION

A variety of techniques and additives has been proposed for sweetening petroleum hydrocarbon fuels such as gasoline. To be acceptable as a motor fuel, gasoline must be Doctor Sweet. Fuels that are Doctor Sweet oftentimes still contain substantial quantities of sulfur compounds, particularly sulfur compounds in the form of diorgano disulfides.

If it were possible to treat sour fuels to render them Doctor Sweet yet, at the same time, reduce a portion of the sulfur content thereof by precipitation of a portion of the offensive mercaptans and other organosulfur compounds such as disulfides, a substantial improvement in the art of fuel sweetening would be provided.

THE INVENTION

The invention comprises a method of sweetening petroleum hydrocarbon fuels and, at the same time, reducing the sulfur content thereof which comprises treating such fuels with a sweetening and sulfur-removing amount of choline.

Specifically, the choline is used in an amount sufficient to render the fuels Doctor Sweet as well as to reduce the sulfur content thereof. This amount will vary, depending upon the amount of sulfur compounds present in the fuel. Generally, amounts between about 300–2,000 ppm of so-called "crude commercial choline" is sufficient to achieve the results of the invention.

There is some confusion in the literature regarding "choline" nomenclature. *Merck Index*, 10th Edition, Merck & Co., Inc., 1983, refers to the cation, only, as choline, i.e.

$$Me_3N^{\oplus}—CH_2CH_2—OH$$

More commonly, however, the literature refers to choline as the hydroxide salt, i.e.

$$Me_3N^{\oplus}—CH_2CH_2—OH^{\ominus}$$

For example, see Journal of Organic Chemistry, Vol. 41, No. 23, 3773(1976).

Because of this confusion, we choose to define "choline" as any and all of the following species:

$$Me_3N^{\oplus}—CH_2CH_2—O^{\ominus} \quad \text{I}$$

$$Me_3N^{\oplus}—CH_2CH_2—OH\ OH^{\ominus} \quad \text{II}$$

$$Me_3N^{\oplus}—CH_2CH_2—OH\ OR^{\ominus} \quad \text{III}$$

where R=alkyl ranging from $C_1$ to $C_{20+}$

All three structures (I, II, and III) are strong bases and all will neutralize naphthenic acids. Structure I is the predominant species regardless of solvent system employed. A small amount of II will coexist with I if water is the solvent or part of a cosolvent. Structure III will be present to a small extent and will be in equilibrium with structure I if an alcohol solvent such as methanol is used. For documentation of these statements, see J. Org. Chem. 41, 3773(1967).

Commercially choline is made by reacting trimethylamine with 1 mole of ethylene oxide in methanol. This reaction is usually conducted to provide a finished methanol solution of choline having a choline concentration ranging between 25–45% by weight. Contained in the reaction mixture is between 0.5–5% by weight of trimethylamine and up to about 15% by weight of various methanol ethoxylates. For purposes of the invention, this crude reaction mixture of choline, trimethylamine and methanol ethoxylates may be used.

EVALUATION OF THE INVENTION

The choline used in the evaluations presented below and the following compositions. These compositions are hereafter referred to as Compositions A, B, and C.

| Ingredients | % by Weight |
|---|---|
| **Composition A** | |
| Choline base, $Me_3\oplus N—CH_2CH_2—O\ominus$ | 33.0% |
| Trimethylamine, $Me_3N$ | 4.5% |
| By products | 7.5% |
| Methanol | 55.0% |
| | 100.0% |
| **Composition B** | |
| Choline base, $Me_3\oplus N—CH_2CH_2—O\ominus$ | 31.1% |
| Trimethylamine, $Me_3N$ | 4.2% |
| By products | 7.1% |
| Water | 5.7% |
| Methanol | 51.9% |
| | 100.0% |
| **Composition C** | |
| Choline base, $Me_3\oplus N—CH_2CH_2—O\ominus$ | 35.80% |
| Trimethylamine, $Me_3N$ | 0.30% |
| Dehazer | 3.23% |
| By products | 7.45% |
| Methanol | 53.22% |
| | 100.00% |

EXAMPLE 1

The sour gasoline was obtained from a midwest refinery. It was Doctor Sour and was found to have 20 ppm of mercaptans by $AgNO_3$ titration.

The gasoline was treated at two different levels of Comp. A. Each sample was shaken for a minute, after which a black precipitate formed in each. The amount of precipitate was proportional to the dose.

After decantation of the sweetened gasoline, acidification of the black $H_2O$ soluble precipitate produced a strong "phenol like" odor which indicates that Comp. A caused phenols as well as thiols (mercaptans) to precipitate. The chemistry is:

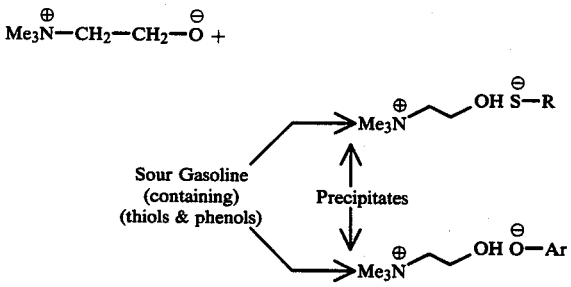

EXAMPLE 2

In order to verify that Comp. A caused thiols to precipitate and not the disulfides resulting from thiol oxidation, stoichiometric choline was added to predosed heptane solutions of octane thiol and dioctyl disulfide.

TABLE I

| Sample | Pre-Dosed With $C_8H_{17}$—SH | $C_8H_{17}$—S—S—$C_8H_{17}$ | Precipitate Formed | $H_2O$ Soluble |
|---|---|---|---|---|
| Blank (heptane) | — | — | No | — |
| Sample 1 | 500 ppm | — | Yes (colorless liquid) | Yes |
| Sample 2 | — | 500 ppm | No | — |

After decantation, acidification of the precipitate from Sample 1 released the odor of $C_8H_{17}$—SH, as expected.

The removal of thiols from the fuel is beneficial since an oxidant (including air and/or an added oxidizer) need be present. This means that Comp. A will sweeten in the absence of air, whereas a conventional sweetener cannot. Additionally, since choline is a much stronger base than MeO—$CH_2CH_2CH_2$—$NH_2$, base catalyzed air oxidiation of thiols to disulfides is much faster.

EXAMPLE 3

Samples of commercial unleaded gasoline were treated with Comp. A in an effort to render the material "Doctor Sweet". Samples were also analyzed for mercaptan content via potentiometric titration with silver nitrate. It is evident from the tests that about 5 ppm residual mercaptan in these samples gave a borderline sweet indication by the Doctor's Test. Apparently choline reacts with the mercaptans present to yield a gummy insoluble complex which effectively removes the mercaptan (and, thus, also sulfur) from solution. This complex, upon isolation, has been found to release mercaptan upon acidification. Results are presented in Table II.

TABLE II

| ppm Comp. A | ppm Residual RSH | Comments |
|---|---|---|
| 0 | 19.19 | Initial - blank |
| 1000 | 0 | After 1 hour - Dr. Sweet immediately |
| 500 | 4.8 | After 1 hour - borderline Dr. Sweet; Dr. Sweet after 2 hours |
| 200 | 7 | 18 hours (nitrogen blanket) |
| 100 | 10 | 18 hours (nitrogen blanket) |
| 50 | 15 | 18 hours (nitrogen blanket) |

EXAMPLE 4

In addition to removing mercaptans from sour fuels by precipitation, Comp. B will also remove partial amounts of other organosulfur compounds. Organosulfur containing simulated fuel samples were prepared by dissolving the sulfur compounds in reagent grade heptane. Each solution was dosed with 1,000 ppm (V/V) of choline (Composition C). After shaking and allowing to stand overnight, the supernatent liquid was decanted from the residue and analyzed for total sulfur:

TABLE III

| Sample | Compound/Dose[1] | Initial Sulfur Content | Sulfur Content After Choline Treatment |
|---|---|---|---|
| A | $CH_3—\overset{O}{\overset{\|\|}{C}}—SH$/3640 ppm | 1,536 ppm[2] | 1,074 ppm |
| B | $C_6H_5—S—S—C_6H_5$/3168 ppm | 995 ppm[3] | 726 ppm |
| C | Di-t-nonyl-polysulfide/2,629 ppm | 913 ppm[3] | 786 ppm |

[1]ppm is on a weight/weight basis.
[2]calculated from dosage
[3]determined by total sulfur analysis Assuming a sulfur containing fuel contains thiolcarboxylic acids (such as A), or disulfides or polysulfides (such as B & C), one would expect a reduction in total sulfur content of the fuel if treated with choline.

EXAMPLE 5

This is an evaluation of the affect of Comp. B on fluidized catalytically cracked (F.C.C.) light gasoline on thiol (mercaptan) removal and total sulfur reduction. This gasoline was treated with various doses of Comp. B, causing a black precipitate to form in all cases. After standing three days, the following results were obtained as set forth in Table IV.

TABLE IV

| Sample | Comp. B. Dosage (ppm) | ppm S (as thiol) | ppm Total Sulfur | % Residue | % S in Residue | Amount of S Removed from Fuel, Found in Residue |
|---|---|---|---|---|---|---|
| A(blank) | — | 330 | 1,072 | — | — | — |
| B | 1,000 | 29 | 1,094 | 0.0956 | 8.47 | 81 ppm |
| C | 1,500 | — | 1,047 | — | — | — |
| D | 2,000 | — | 1,058 | — | — | — |
| E | 4,000 | — | 967 | 0.339 | 2.98 | 101 ppm |
| F | 9,000 | — | 991 | — | — | — |

This data shows that when the gasoline is treated at 1,000 ppm, sulfur reduction did not appear in the supernatant analysis, but did show up as 81 ppm in residue analysis. This gasoline analysis invariance probably reflects poor reproducibility of the analytical method. At the 4,000 ppm treat level, however, sulfur reduction shows up in both supernatant and residue analysis at 100 ppm. An earlier batch of F.C.C. gasoline showed a somewhat greater sulfur reduction:

TABLE V

| Sample | Comp. C | ppm S (as thiol) | ppm Total Sulfur |
|---|---|---|---|
| A(Blank) | — | 320 | 1,368 |
| B | 1,000 ppm | 22 | 1,207 |

Here, a sulfur reduction of 161 ppm has been effected.

A conclusion that can be drawn from both data sets is, assuming that only thiols were removed from the fuel as a precipitate, only $\frac{1}{3}$–$\frac{1}{2}$ of the thiol content is precipitated. The remainder is air oxidized to disulfides under the influence of base catalysis.

What is claimed is:

1. A method of sweetening petroleum hydrocarbon fuels and, at the same time, reducing the sulfur content thereof which comprises treating such fuels with a sweetening and sulfur-removing amount of choline.

* * * * *